US005711257A

United States Patent [19]

Buford et al.

[11] Patent Number: 5,711,257

[45] Date of Patent: Jan. 27, 1998

[54] SLEEVED BOILER-REACTOR

[75] Inventors: John T. Buford; Jeffrey M. Makulec, both of Rockford, Ill.

[73] Assignee: Sundstrand Corporation, Rockford, Ill.

[21] Appl. No.: 590,843

[22] Filed: Jan. 24, 1996

[51] Int. Cl.[6] ..... F22B 1/02

[52] U.S. Cl. ..... 122/32; 122/21

[58] Field of Search ..... 122/367.1, 367.2, 122/367.3, 21, 32

[56] References Cited

U.S. PATENT DOCUMENTS

| | | | |
|---|---|---|---|
| 3,964,416 | 6/1976 | Kiraly et al. | 122/32 |
| 4,634,479 | 1/1987 | Buford | 149/6 |
| 4,671,211 | 6/1987 | Buford | 122/4 R |
| 4,680,934 | 7/1987 | Short | 60/652 |
| 4,771,738 | 9/1988 | Ewbank | 122/32 |
| 4,846,112 | 7/1989 | Buford et al. | 122/21 |
| 4,846,113 | 7/1989 | Morgan et al. | 122/21 |

*Primary Examiner*—Henry A. Bennett
*Assistant Examiner*—Gregory A. Wilson
*Attorney, Agent, or Firm*—Lawrence E. Crowe

[57] ABSTRACT

A sleeved boiler-reactor provides enhanced nucleate boiling and reduced risk of film-boiling within boiling tubes of the boiler-reactor, in the same manner as prior boiler-reactors of seam-welded construction, without the high fabrication cost incident with seam-welding, through the use of a closely wound helical shaped boiling tube structure constrained by lugs against a sleeve portion of the casing of the boiler-reactor.

6 Claims, 1 Drawing Sheet

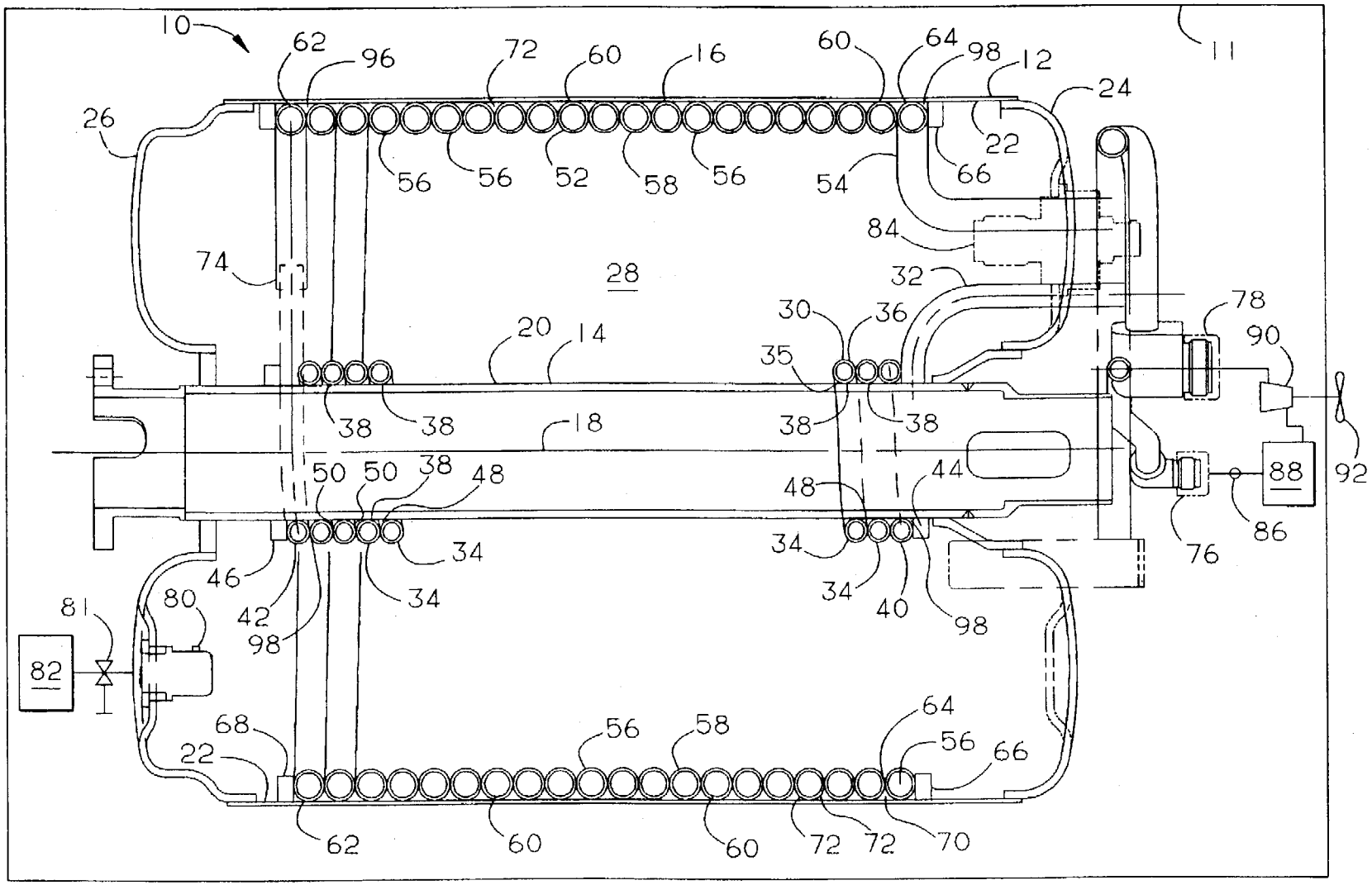
92
90
88
86
78
76
11
24
12
22
98
66
64
60
54
84
32
36
38
44
40
34
30
35
48
56
58
16
28
14
18
20
52
72
96
62
74
10
26
50
42
46
80
81
82
68
70

SLEEVED BOILER-REACTOR

FIELD OF THE INVENTION

Our invention relates to improvements in a boiler-reactor having particular utility in steam boilers of the type used for steam propelled torpedoes.

BACKGROUND

Steam boilers used in torpedo propulsion units generally include a casing defining a cavity for a hot reactant bath. One or more boiling tube assemblies are disposed within the casing for conducting water through the reactant bath so that heat generated in the reactant bath can be transferred to convert the water into steam for driving the torpedo.

In one commonly utilized prior construction for such boiler-reactors, as illustrated by U.S. Pat. Nos. 3,964,416 to Kiraly and 4,680,693 to Short, the boiler tube assemblies are fabricated and supported within the casing in a manner allowing the reactant bath to freely flow about the entire outer circumferential surface of the tubes in the boiling tube assembly. Specifically, the boiling tube structure is fabricated as a continuously helically coiled tube, having a plurality of spaced apart turns. The boiling tube structure is further supported within the cavity in such a manner that the turns are disposed far enough from the walls of the casing to allow the reactant bath to freely circulate about the entire periphery of each turn of the boiling tube structure.

By allowing the molten reaction bath to contact the entire periphery of the boiling tubes, it was thought that a maximum rate of heat transfer could be achieved. In practice, however, the intense reaction in a typical boiler-reactor of this type causes the water within the tubes to boil so rapidly that a thermally insulative vapor film of steam is generated within the boiling tubes. The vapor film forces liquid within the tubes away from the tube walls and thus slows rather than enhances heat transfer.

In order to maximize heat transfer, a boiler-reactor must be constructed in such a manner Chat a film-boiling condition, as described above, does not prevent the liquid phase of water in the boiling tubes from directly contacting a substantial portion of the walls of the boiling tubes. Where the liquid is allowed to directly contact the walls, the fluid boils by forming bubbles of vapor in a process known as nucleate boiling. Nucleate boiling provides a significantly higher heat transfer efficiency than film-boiling.

In one prior approach to enhancing nucleate boiling and preventing such a film-boiling condition, as illustrated by U.S. Pat. Nos. 4,771,738 to Ewbank and 4,846,112 to Buford, the adjacent turns of the boiling tube structures are seam welded together and are utilized to form part of the casing. In such boiler-reactors, only the inward facing half of the boiling tubes are exposed to the reactant bath; the outward facing surfaces being exposed only to the cooler ambient environment outside of the casing. Although such an arrangement has proved to be effective in enhancing heat transfer by greatly reducing the risk of film-boiling, the seam welding required to fabricate the boiling tube structure entails significant inherent cost related to the difficulty involved in precisely controlling the welding process, and because it is difficult to adequately identify flaws in the seam welds with non-destructive testing.

It is therefore an object of our invention to provide an improved boiler-reactor, which enhances nucleate boiling and significantly reduces the risk of film-boiling, that can be fabricated at lower cost and is inherently more reliable than prior boiler-reactors which utilized seam welded tube structures.

SUMMARY

Our invention provides such an improved boiler-reactor through the use of a casing including a cylindrical sleeve defining a longitudinal axis and a first interior surface of the casing. A first and a second end closure are integrally attached respectively to opposite axial ends of the sleeves to define a cavity for receipt of a reaction bath within the casing. A boiling tube structure comprises a tube formed to define a plurality of turns that are continuously helically disposed within the cavity in fluid communication with one another about the longitudinal axis. Each of the turns of th tube structure are wound to closely axially abut an adjacent turn of the tube structure, and further wound to have a portion Of an outer surface thereof which circumferentially abuts the interior surface of the casing of the boiler reactor. Lugs are attached to the casing in such a manner to urge the individual turns of the boiling tube structure into substantially integral axial abutment with the adjacent turns of the boiling tube structure. The axial abutment of the adjacent turns in conjunction with the circumferential abutment of the turns with the interior surface of the casing defines a helically shaped channel extending generally axially along the tube structure between the interior surface of the casing and a portion of the outer surfaces of each of the turns that faces the interior surface of the cylindrical sleeve. By virtue of its convoluted shape, the helically shaped channel substantially reduces circulation of the reaction bath across the portion of the outer surface of each of the turns that faces the interior surface of the casing. In some embodiments of our invention, it may also be desirable to include additional structural elements configured for substantially preventing entry of the reactant bath into the helically shaped channel.

The sleeved boiler-reactor of our invention therefore provides a construction which enhances nucleate boiling and significantly reduces the risk of film boiling, and that can be fabricated at lower cost than those prior seam welded boiler-reactors by virtue of utilizing the sleeve to eliminate the need for seam welding of the boiling tube structure.

These and other aspects and advantages of our invention will be apparent to those having skill in the art upon consideration of the following drawing figure and detailed description of an exemplary embodiment of our invention.

BRIEF DESCRIPTION OF THE DRAWING

The drawing is a longitudinal section of an exemplary embodiment of our invention, portions being broken away and other portions being shown diagrammatically.

DESCRIPTION OF THE INVENTION

The drawing depicts an exemplary embodiment of our invention in the form of a boiler-reactor, generally illustrated as reference numeral 10 for an underwater vehicle 11 such as a torpedo.

The boiler-reactor 10 includes a casing 12 having a first and a second cylindrical sleeve portion 14, 16 disposed in a coaxial concentric relationship about a common longitudinal axis 18 to respectively define a first and a second interior surface 20, 22 of the casing 12. The casing 12 further includes a first and a second end closure 24, 26 at opposite axial ends thereof interconnecting the first and second sleeve portions 14, 16 such that the casing 12 defines an annular shaped cavity 28 for confining a reactant bath (not shown).

A first boiling tube structure 30 includes a first tube 32 formed to define a plurality of turns 34 continuously helically disposed in fluid communication with one another about the longitudinal axis 18. Each of the turns 34 of the first tube structure 30 is wound to closely axially abut an adjacent turn 34 of the first boiling tube structure 30, and further wound to have a portion 35 of an outer surface 36 thereof substantially circumferentially abutting the first interior surface 20 of the casing 12, as indicated at reference numeral 38. The first boiling tube structure 30 further includes a first and a last turn 40, 42 disposed at opposite axial ends thereof, respectively adjacent to the first and second enclosures 24, 26 of the casing 12. First lug means in the form of a first set of lugs 44 disposed to contact the first turn 40 of the tube structure 30, and a second set of lugs 46 disposed to contact the last turn 42 of the tube structure 30 extend from and are integrally attached as by welding to the first sleeve 14 for urging the turns 34 of the first boiling tube structure 30 into substantially intimate axial abutment with the adjacent turns 34 of the first boiling tube structure 30, in a manner similar to compressing a helical spring to its solid height. This intimate axial abutment of the adjacent turns 34, in conjunction with the circumferential abutment of the turns 34 of the first boiling tube structure 30 with the first interior surface 20, as indicated typically at reference numeral 38, defines a first helically shaped channel 48 that extends generally axially along the first tube structure 30, between the first interior surface 20 of the casing 12, and a portion 50 of the outer surfaces 36 of each of the turns 34 that generally faces the first interior surface 20. Those having skill in the art will recognize that by virtue of the convoluted shape and relatively small cross-section of the first helically shaped channel 48, circulation of the reaction bath across the portion 50 of each of the turns 34 is substantially reduced, to thereby significantly preclude the risk that film-boiling will occur within the first boiling tube structure 30.

The boiler-reactor 10 further includes a second boiling tube structure 52 comprising a second tube 54 formed to define a plurality of turns 56 which are continuously helically disposed in fluid communication with one another about the longitudinal axis 18. Each of the turns 56 of the second tube structure 52 is wound, in a manner similar to that described above with respect to the first boiling tube structure, to closely axially abut an adjacent turn 56 of the second boiling tube structure 52, and further wound to have a portion of an outer surface 58 thereof substantially circumferentially abutting the second interior surface 22 of the casing 12, as indicated typically at reference numeral 60.

The second boiling tube structure 52 further includes a first and a last turn 62, 64 disposed at opposite axial ends thereof, respectively adjacent to the second and first enclosures 26, 24 of the casing 12. Second lug means in the form of a first set of lugs 68 disposed to contact the first turn 62 of the tube structure 52, and a second set of lugs 66 disposed to contact the last turn 64 of the tube structure 52 extend from and are integrally attached as by welding to the second sleeve 16 for urging the turns 56 of the second boiling tube structure 52 into substantially intimate axial abutment with the adjacent turns 56 of the second boiling tube structure 52, in a manner similar to compressing a helical spring to its solid height. This intimate axial abutment of the adjacent turns 56, in conjunction with the circumferential abutment of the turns 52 of the second boiling tube structure 52 with the second interior surface 22, as indicated typically at reference numeral 60, defines a second helically shaped channel 70 that extends generally axially along the second tube structure 52, between the second interior surface 22 of the casing 12, and a portion 72 of the outer surfaces 58 of each of the turns 56 that generally faces the second interior surface 22. Those having skill in the art will recognize that by virtue of the convoluted shape and relatively small cross-section of the second helically shaped channel 72, circulation of the reaction bath across the portion 72 of each of the turns 56 is substantially reduced, to thereby significantly preclude the risk that film-boiling will occur within the second boiling tube structure 52.

As indicated schematically at reference numeral 74, the last turn 42, of the first boiling tube structure 30, is joined in fluid communication to the first turn 62 of the second boiling tube structure 52 in sch a manner that a single fluid channel for the fluid passing through the boiler-reactor 10 to be heated by the reactant bath is provided. The first end of the first turn 32 is configured to pass in a fluid tight manner through the first end closure 24 for termination at an inlet fitting 76. In similar fashion, the second end 54 of the second boiling structure 52 is configured downstream of the last turn 64 to pass through the first end closure 24 and terminate at an outlet fitting 78.

The boiler-reactor 10 further includes one or more oxidant injectors 80 configured to receive oxidant via a control valve means 81 from an oxidant source 82 and inject the oxidant into the annular cavity 28. The boiler-reactor 10 also includes an ignition device 84 of any type known in the art, such as a pyrotechnic device, or an electric match.

The annular cavity 28 is filled with a reactant (not shown) which when ignited by the ignition device 84 and supplied with an oxidant by the oxidant injectors 80 will create an intense heat by virtue of an exothermic chemical reaction. In torpedo propulsion systems, the reactant often includes a metallic lithium compound which is oxidized with sulfur hexafluoride to produce the desired exothermic chemical reaction. A form of metallic lithium having particular utility in such applications is provided by micro-encapsulated lithium pellets coated with a predominantly fluorine substituted hydrocarbon, as taught by U.S. Pat. No. 4,671,211 to Buford which is incorporated herein by reference. In a related U.S. Pat. No. 4,634,479, Buford also teaches a particularly advantageous method for installing such micro-encapsulated metallic lithium pellets into the cavity 28 of a boiler-reactor 10 such as described herein, that method also being incorporated herein by reference.

In the propulsion system for the torpedo 11 depicted in the drawing, a pump 86 provides a flow of a vaporizable working fluid such as water to the boiler-reactor 10 via the inlet fitting 76. A flow of an oxidant such as sulfur hexafluoride is provided to the cavity 28 by the oxidant injectors 80. Once the ignition device 84 is triggered, an intense exothermic reaction will commence between the metallic lithium reactant and the oxidant within the cavity 28, thereby creating a hot molten reactant bath. Where metallic lithium and sulfur hexafluoride are utilized to create this reaction, the temperature of the molten reactant bath can exceed 2,000° F. As the vaporizable liquid supplied by the pump 86 makes its way through the first and second boiling tube structures 30, 52, the liquid within the tubes begins to boil and eventually exits the boiler at a high pressure and in a super heated form, of for instance about 1,100° F. where water is used as a vaporizable fluid. The vapor exiting the boiler-reactor 10 via the outlet fitting 78 is supplied to a turbine 90 which in turn drives a suitable propulser such as the propeller 92. In general, such torpedo propulsion systems operate in a closed loop fashion such that the working fluid exiting the turbine 90 is fed to a condenser 88 wherein the working fluid returns to a liquid state to be drawn from the condenser by the pump 86 and fed back to the boiler-reactor 10. Once the exothermic reaction is initiated, the temperature within the cavity 28 and the rate at which the reaction progresses may be regulated to some extent by utilizing the valve means 81 for controlling the flow rate of oxidant through the oxidant injectors 80, in a manner well known in the art. From the foregoing description, those having skill in the art will readily recognize that our invention overcomes problems encountered in prior boiler-reactors by providing an improved boiler-reactor which enhances nucleate boiling while significantly reducing the risk of film-boiling and yet can be fabricated at significantly lower cost than prior boiler-reactors which utilize seam welded tube structures.

Those skilled in the art will further recognize that although we have described our invention herein with respect to specific embodiments and applications thereof, many other embodiments and applications of our invention are possible within the scope of our invention as described in the appended claims. For example, other types of reactants, oxidants, and working fluids may be utilized with equal or greater efficacy in other embodiments or applications of our invention within the scope of the appended claims. We wish to specifically state that our invention is not limited to use in the propulsion system of a torpedo or other types of vehicle. As illustrated in the drawing, the first and second tubes 32, 54 are of different diameters. Specifically, the first tube 32 is of a smaller diameter then the second tube 54. Although such an arrangement is normally preferred, because the volume of the working fluid increases significantly as it vaporizes while traveling from the inlet 76 to the outlet 78 of the boiler-reactor 10, there is no necessity that tubes of differing sizes be utilized. Furthermore, those having skill in the art will recognize that our invention may be practiced in boiler-reactors having a cylindrical rather than an annular cavity for receipt of the reactant, and that in such a boiler it may be desirable to use only a single boiling tube structure rather than a first and second boiling tube structure as illustrated in the drawing. The drawing generally illustrates a casing constructed by integrally joining the first and second sleeves and first and second end closures by a process such as welding, but other means of joining the constitutant parts, such as bolting may also be utilized within the scope of our invention.

Although the convoluted shape of the first and second helically shaped channels 48, 70 will generally inhibit circulation of the reaction bath through the helically shaped channels to such a degree that film-boiling will be precluded, it may be desirable in some embodiments to further include means, as indicated at 96 and 98 for substantially blocking and preventing entry of the reactant bath into the helically shaped channel. Such means for preventing entry may be provided by contoured blocks configured to fit within the helically shaped channels at alternate axial ends thereof. It may also be desirable where the method for fueling the boiler-reactor taught by the '479 patent to Buford is utilized to provide a fungible means for blocking entry into the helically shaped channels during the fueling process. Such a fungible means may be readily provided through the use of a material such as a silicone sealant, of a compound having sufficient thermal resistance to allow fueling, but not necessarily high enough to prevent oxidation or vaporization when exposed to the extremely high temperatures of the exothermic reaction.

It is understood, therefore, that the spirit and scope of the appended claims should not be limited to the specific embodiments described and depicted herein.

We claim:

1. A boiler-reactor comprising:

a) a casing including a first cylindrical sleeve defining a longitudinal axis and a first interior surface of said casing;

b) a first and a second end closure integrally attached respectively to opposite axial ends of said sleeve to define a cavity for receipt of a reaction bath within said casing;

c) a first boiling tube structure comprising a first tube formed to define a plurality of turns continuously helically disposed within said cavity in fluid communication with one another about said longitudinal axis; each of said turns of said tube structure being wound to closely axially abut an adjacent turn of said structure, and further wound to have a portion of an outer surface thereof circumferentially abutting said interior surface of said casing; and d) lug means attached to said casing for urging said turns into substantially intimate axial abutment with said adjacent turns of said first boiling tube structure and thereby limiting fluid communication of said reaction bath between said cavity, and said casing;

e) said axial abutment of said adjacent turns in conjunction with said circumferential abutment of said turns with said interior surface defines a helically shaped channel extending generally axially along said first of said outer surfaces of each of said turns that generally faces said interior surface, whereby said helically shaped channel substantially reduces circulation of said reaction bath across said portion of said outer surface of each of said turns that generally faces said interior surface.

2. The boiler-reactor of claim 1 further including means for substantially preventing entry of said reactant bath into said helically shaped channel.

3. The boiler-reactor of claim 1 wherein:

said first tube structure includes a first and a last turn disposed at opposite axial ends thereof respectively adjacent said first and second axial ends of said casing; and said lug means include a first set of lugs disposed to contact said first turn of said tube structure, and a second set of lugs disposed to contact said last turn of said tube structure.

4. The boiler-reactor of claim 3 wherein:

a) said casing further includes a second cylindrical sleeve disposed about said longitudinal axis and defining a second interior surface of said casing;

b) said first and second end closures of said casing are further integrally attached to said second sleeve at opposite axial ends of said second sleeve, whereby said cavity within said casing is partially defined by said first and second interior surfaces;

c) a second boiling tube structure comprising a second tube formed to define a plurality of turns continuously helically disposed within said cavity in fluid communication with one another about said longitudinal axis; each of said turns of said second tube structure being wound to closely axially abut an adjacent turn of said second tube structure, and further wound to have a radially facing surface thereof closely circumferentially abutting said second interior surface of said casing; and d) second lug means attached to said casing for urging said turns of said second tube structure into said axial abutment respectively with said adjacent turn of said second tube structure and aid second interior wall of said casing.

5. The boiler-reactor of claim 4 wherein:

said second tube structure includes a first and a last turn disposed at opposite axial ends thereof respectively adjacent said first and second axial ends of said casing; and said second lug means include a first set of lugs disposed to contact said first turn of said second tube structure, and a second set of lugs disposed to contact said last turn of said second tube structure.

6. A boiler-reactor comprising a) a casing having a first and a second cylindrical sleeve portion disposed in a coaxial concentric relationship about a common longitudinal axis to respectively define a first and a second interior surface of said casing;

said casing further having first and second closures at opposite axial ends thereof interconnecting said first and second sleeve portions such that said casing defines an annular cavity for confining a reactant bath;

b) a first boiling tube structure comprising a first tube formed to define a plurality of turns continuously helically disposed in fluid communication with one another about said longitudinal axis;

each of said turns of said first tube structure being wound to closely axially abut an adjacent turn of said structure, and further wound to have a portion of an outer surface thereof circumferentially abutting said first interior surface of said casing;

c) first lug means attached to said first sleeve for urging said turns of said first boiling tube structure into substantially intimate axial abutment with said adjacent turns of said tube structure;

d) said axial abutment of said adjacent turns in conjunction with said circumferential abutment of said turns of said first boiling tube structure with said first interior surface defining a first helically shaped channel extending generally axially along said first tube structure between said first interior surface of said casing and a portion of said outer surfaces of each of said turns that generally faces said interior surface, whereby said helically shaped channel substantially reduces circulation of said reaction bath across said portion of said outer surface of each of said turns of said first boiling tube structure that generally faces said first interior surface;

e) a second boiling tube structure comprising a second tube formed to define a plurality of turns continuously helically disposed in fluid communication with one another about said longitudinal axis;

each of said turns of said second tube structure being wound to closely axially abut an adjacent turn of said structure, and further wound to have a portion of an outer surface thereof circumferentially abutting said second interior surface of said casing; and f) second lug means attached to said second sleeve for urging said turns of said second boiling tube structure into substantially intimate axial abutment with said adjacent turns of said second tube structure;

g) said axial abutment of said adjacent turns in conjunction with said circumferential abutment of said turns of said second boiling tube structure with said second interior surface defining a second helically shaped channel extending generally axially along said second tube structure between said second interior surface of said casing and a portion of said outer surfaces of each of said turns that generally faces said second interior surface, whereby said second helically shaped channel substantially reduces circulation of said reaction bath across said portion of said outer surface of each of said turns of said second boiling tube structure that generally faces said second interior surface.

* * * * *